US011098587B2

(12) United States Patent
Hoffmann

(10) Patent No.: US 11,098,587 B2
(45) Date of Patent: Aug. 24, 2021

(54) ROTARY PISTON ENGINE AND METHOD FOR OPERATING A ROTARY PISTON ENGINE

(71) Applicant: Fuelsave GmbH, Walldorf (DE)

(72) Inventor: Dirk Hoffmann, Buchholz (DE)

(73) Assignee: FUELSAVE GMBH, Walldorf (DE)

( * ) Notice: Subject to any disclaimer, the term of this patent is extended or adjusted under 35 U.S.C. 154(b) by 0 days.

(21) Appl. No.: 16/969,634

(22) PCT Filed: Feb. 8, 2019

(86) PCT No.: PCT/EP2019/053215
§ 371 (c)(1),
(2) Date: Aug. 13, 2020

(87) PCT Pub. No.: WO2019/158449
PCT Pub. Date: Aug. 22, 2019

(65) Prior Publication Data

US 2020/0400022 A1 Dec. 24, 2020

(30) Foreign Application Priority Data

Feb. 14, 2018 (EP) ..... 18156764.5

(51) Int. Cl.
*F03C 2/00* (2006.01)
*F03C 4/00* (2006.01)
(Continued)

(52) U.S. Cl.
CPC ..... *F01C 1/123* (2013.01); *F01C 21/08* (2013.01); *F04C 2/123* (2013.01);
(Continued)

(58) Field of Classification Search
CPC ..... F04C 2/084; F04C 2/123; F04C 15/0007; F04C 15/0015; F01C 1/084; F01C 1/123; F01C 19/025; F01C 21/008
See application file for complete search history.

(56) References Cited

U.S. PATENT DOCUMENTS 67,978 A * 8/1867 Handford ..... F04C 2/084 418/191
1,436,263 A * 11/1922 Johnson ..... F04C 18/344 418/192
(Continued)

FOREIGN PATENT DOCUMENTS

DE 102007019958 A1 2/2008
EP 3144471 A1 * 3/2017 ..... F01C 1/123
(Continued)

OTHER PUBLICATIONS

DE102007019958A1—HITTRICH—Multiple teeth double rotary piston motor for use as drive in e.g. motor vehicle, has two rotary pistons rotating into one another in enclosed housing, and gearing with very small module attached at pitch circle of each rotary piston—Feb. 21, 2008—English Translation. (Year: 2008).*
(Continued)

*Primary Examiner* — Theresa Trieu
(74) *Attorney, Agent, or Firm* — Hoffman Warnick LLC

(57) ABSTRACT

A rotary piston engine comprises a housing (10), which forms an interior space (11), and at least two rotary pistons (20, 30), which are arranged in the interior space (11). Formed on the interior space (11) are an inlet opening (13) and an outlet opening (15) to guide a fluid through the interior space (11). The rotary pistons (20, 30) are thereby driven by fluid flowing through. Each rotary piston (20, 30) has on its outer circumference at least two sealing strips (21, 31). According to the invention each rotary piston (20, 30) comprises at least two cavities (27, 37), in each of which a
(Continued)

tube (38B) or an elastic solid rod is arranged. The sealing strips (21, 31) project into the cavities and against the tube (38B) received therein or the elastic solid rod. Through the tube (38B) or the rod, the sealing strips (21, 31) are pushed radially outwards.

13 Claims, 4 Drawing Sheets

(51) Int. Cl.

| | |
|---|---|
| ***F04C 2/00*** | (2006.01) |
| ***F04C 18/00*** | (2006.01) |
| ***F01C 1/12*** | (2006.01) |
| ***F01C 21/08*** | (2006.01) |
| ***F04C 2/12*** | (2006.01) |
| ***F04C 15/00*** | (2006.01) |
| *F01C 1/08* | (2006.01) |
| *F01C 19/02* | (2006.01) |

(52) U.S. Cl.
CPC ..... *F04C 15/0007* (2013.01); *F04C 15/0015* (2013.01); *F01C 1/084* (2013.01); *F01C 19/025* (2013.01)

(56) References Cited

U.S. PATENT DOCUMENTS

| | | | | |
|---|---|---|---|---|
| 1,923,268 | A * | 8/1933 | Jensen | F04C 2/123 418/206.1 |
| 4,165,209 | A * | 8/1979 | Eiermann | F01C 1/123 418/190 |
| 4,506,637 | A | 3/1985 | Reinhold | |
| 2013/0216417 | A1 * | 8/2013 | Dixon | F04C 15/0015 418/143 |
| 2014/0056746 | A1 * | 2/2014 | Flavelle | F04C 2/084 418/192 |
| 2018/0258768 | A1 * | 9/2018 | Hoffmann | F01N 5/04 |

FOREIGN PATENT DOCUMENTS

| | | | | |
|---|---|---|---|---|
| EP | 3144494 | A1 * | 3/2017 | F01C 1/123 |
| EP | 3184758 | A1 * | 6/2017 | F01K 25/08 |
| GB | 576603 | | 4/1946 | |
| GB | 2486787 | A | 6/2012 | |
| WO | WO-2010081469 | A2 * | 7/2010 | F01C 1/123 |

OTHER PUBLICATIONS

International Written Opinion for PCT Application No. PCT/EP2019/053215, dated May 15, 2019, 5 pages.

* cited by examiner

ROTARY PISTON ENGINE AND METHOD FOR OPERATING A ROTARY PISTON ENGINE

FIELD OF THE INVENTION

The present invention relates in a first aspect to a rotary piston engine.

In a second viewpoint the invention relates to a method for operating a rotary piston engine.

RELATED ART

Rotary piston engines are used in various ways to convert energy, in particular to convert pressure energy or kinetic energy of a flowing fluid into rotation energy of one or more rotary pistons.

A generic rotary piston engine comprises a housing, which forms an interior space, and at least two rotary pistons which are arranged in the interior space. Disposed on the interior space are an inlet opening and an outlet opening for guiding a fluid through the interior space. The fluid flows along the rotary pistons so that in particular the rotary pistons can be driven by fluid flowing through.

In principle the fluid can be of any kind, for example any liquid, any gas or a mixture thereof, which can also contain solid particles. Fluids used differ in particular depending on the field of application of the rotary piston engine. For example, the fluid can be exhaust gas of an internal combustion engine or another combustion force-based engine. It can also be a fluid in a cycle with which waste heat is utilised. This may be desired in power stations, manufacturing plants, heating installations and a multitude of other plants and installations.

To ensure a maximum possible level of efficiency of a rotary piston engine, the sealing properties thereof are important. In the generic rotary piston engine, each rotary piston comprises on its outer circumference at least two sealing strips which are resiliently pushed outwards. The sealing strips can thereby sealingly contact the housing inner wall that defines the interior space.

Such rotary piston engines are known for example from DE 102007019958 A1, GB 576603 A, GB 2486787 A and WO 2010081469 A2. Further rotary piston engines having an advantageously low friction were described by the applicant in EP 3144494 A1, EP 3184758 A1 and EP 3144471 A1.

In a corresponding generic method for operating a rotary piston engine a fluid is introduced through an inlet opening on a housing. The housing forms an interior space, in which at least two rotary pistons are arranged. As the fluid flows through the interior space to an outlet opening said fluid drives the rotary pistons. Each rotary piston comprises on its outer circumference at least two sealing strips which are resiliently pushed outwards.

SUMMARY OF THE INVENTION

It can be seen as an object of the invention to indicate a rotary piston engine and a method for operating a rotary piston engine which facilitates a particularly high efficiency at the same time as having the longest possible service life of the engine.

This object is achieved by the rotary piston engine having the features described herein and by the method described herein.

Advantageous variants of the rotary piston engine according to the invention and the method according to the invention are the subject matter of the dependent claims and are further explained in the following description.

In the rotary piston engine of the abovementioned type and the method of the abovementioned type, each rotary piston comprises according to the invention at least two cavities, in each of which an elastic elongated or cylindrical deformation body, which comprises a tube or an elastic solid rod, is arranged. The sealing strips project into the cavities and against the tube or the elastic solid rod received in the respective cavity, whereby the sealing strips are pushed radially outwards.

The tube or the solid rod can consist of, or comprise, in particular silicone or another elastic, metal-free material.

Advantageously, an elastic elongated or cylindrical deformation body causes a largely uniform pressure upon the sealing strip over the whole length thereof. The length here is the dimension in the axial direction of the rotary pistons. In addition, the shape and configuration of a cylindrical deformation body provide a stable and long-lasting design, which still extensively fulfils its function of exerting sufficient pressure upon the sealing strips even in the event of cracks in the deformation body. There are thus no substantial risks of damage to the engine in the event of damage to the deformation body, which is a significant advantage in particular compared to metallic resilience means.

In the prior art metallic springs are generally used to outwardly pre-tension the sealing strips. If metallic springs are damaged or break there is the risk of metal splinters penetrating into other parts of the engine and causing considerable damage there. Furthermore, metal springs exert a pressure only in a relatively small area, so that a sealing strip is not pushed outwards uniformly over its length. A non-uniform, or uneven, pressure inevitably leads, however, to an unnecessarily high pressure prevailing in some areas, whereby friction losses increase unnecessarily, while in other areas there could be a pressure that is too low, which does not achieve a sufficient sealing and thus impairs the level of efficiency of the engine.

DE 102007019958 A1 uses for example a metallic leaf spring 17 which does not achieve a uniform pressure over the length of the sealing strip 4. Besides, a break in the metallic leaf spring can cause severe damage to the engine. In GB 576603 A, coil springs 19 are used which likewise do not exert a uniform pressure and these are indeed made of metal. In a comparable way, in GB 2486787 A, a spring 52 is used, and in WO 2010081469 A2, springs shown in a coil shape are used. It is specifically through vibrations here that there is a serious risk of damage to the springs with resulting damage to the engine.

In contrast, aspects of the invention offer a more even and thus lower-friction seal via the sealing strips, wherein risks due to material fatigue are reduced. In various aspects, the deformation body comprises or consists of a non-metallic material, in particular rubber or silicone elastomers such as silicone or other silicon organic compounds, carbon, nylon or plastic. In this way, the entire resilience means of the sealing strips can be designed without metals.

It is a further advantage that cylindrical deformation bodies can be exchanged particularly simply after a defined maintenance interval. Fine-motor positioning as in the case of coil springs is not necessary.

The cavities in which the cylindrical deformation bodies are received can also be cylindrical and extend in the longitudinal direction of the rotary pistons, in particular parallel to the longitudinal axis/axis of rotation of the rotary pistons. The cavities and the deformation bodies received therein are respectively located radially inwards from an associated sealing strip. In principle the cavities can also be interconnected or be formed by a common free space, provided that it is ensured that the deformation bodies cannot move from one cavity to the other, but, rather, that they are held essentially fixed in location and are merely deformed, but not displaced, or are hardly displaced.

The tube/cylindrical deformation body can extend over the whole length of the cavity, the tube thereby being in contact over the whole length with the associated sealing strip and pushing said sealing strip outwards. In particular the contact can be continuous, thus without gaps or uninterrupted, over the whole length of the cavity, which is in contrast with conventionally used coil springs or leaf springs.

The deformation body in a cavity can be integrally formed or can be formed in principle also by a plurality of separate cylindrical deformation body units which are arranged in the cavity one behind the other in the longitudinal direction, for example a plurality of tubes lined up one beside the other. Therefore, a tube can be formed by a plurality of tube components, or a rod can be formed by a plurality of rod components, which are arranged in the respective cavity one above the other. For simplified language use, reference is generally made in this description to "a" (i.e. one) deformation body or "a" (i.e. one) tube, which is arranged in a cavity. This must not be construed to mean that no further deformation bodies/tubes, having the same or a different design, are additionally arranged in the same cavity. This can be advantageous in order to achieve a certain separation with respect to possible formation of cracks in one of a plurality of deformation bodies in the same cavity. A tube or a tube component describes a hollow body, whereas the solid rod or rod components are not hollow. The elongated rod form can also be formed by a plurality of solid rod components which have different forms or shapes in themselves, for example being spherical bodies or balls, which are stacked one on top of the other to form a rod made of solid components. Mixtures of tube components and rod components are also possible. However, a single deformation body for each cavity can be useful in order to facilitate simple maintenance or exchange procedures. The description of an "elongated" deformation body can be defined in that its length (or dimension in the direction of the axis of rotation of the associated rotary piston) is at least 5 times greater than its diameter (or dimension in a direction perpendicular to the axis of rotation of the rotary piston).

A configuration of the elastic cylindrical deformation body as a tube offers a particularly good elasticity with a large spring travel at the same time as high stability and long service life. A tube is to be understood to be an elongated hollow body, but wherein the deformation body can in principle also have a solid rod form, whereby the service life can be further improved under certain conditions. Preferably, the deformation body itself is made of an elastic material, but it is also conceivable for an elastic support bearing to push a non-elastic cylindrical body/deformation body against the sealing strips.

The deformation bodies can be circular or oval in cross-section, wherein, as described, a hollow ring shape can be used. However, other cross-sectional shapes or forms can also be used, for example angular, rectangular or star-shaped. The cross-section is to be regarded in the whole of the present description as a section perpendicular to a longitudinal axis or axis of rotation of the rotary pistons. The two cross-sectional dimensions perpendicular to each other that span the cross-section of the tube or the solid rod are referred to in the present case as X and Y cross-sectional dimensions. The X and Y cross-sectional dimensions of the tube or the solid rod can be substantially equal in size, for example deviating from each other by maximum 10%, which constitutes a difference from for example leaf springs formed by a thin metal sheet.

The cylindrical shape can be understood in that the deformation body has an elongated form, of which the dimension in the axial direction of the rotary piston is at least five times greater than its cross-sectional dimension. The cylindrical form can have an identical cross-section shape or size over its length.

The tube or deformation body can have an external radius that is substantially equal to a radius of the cavity in which the deformation body is received. If the cavity does not have a circular shaped cross-section, its radius can be regarded as the shortest distance from the cavity mid-point to a wall of the cavity.

Instead of a circular shaped cross-section the cavity can also comprise, in cross-section, one or a plurality of segments of a circle and one or a plurality of further areas in a different shape, whereby the introduction of the tubular deformation body into the cavity can be facilitated.

In its cross-section each cavity has a dimension in the radial direction of the associated rotary piston and a dimension perpendicular thereto, i.e. in the circumferential direction of the associated rotary piston. The dimension in the radial direction can be smaller than the dimension in the circumferential direction. It can hereby be ensured that, when the tube or deformation body is inserted, a portion of the cavity is still free in the circumferential direction, while the tube or deformation body fills the cavity, or fills it as extensively as possible, in the radial direction. In the event of a compression of the tube in the radial direction of the rotary piston, the tube can expand into the portion of the cavity that is still free. In this way the possible radial compression distance of the tube is increased.

Each sealing strip can have a widened central region in its cross-section. This widened central region engages in a corresponding retaining groove in the respective rotary piston. Through this, a movement space of the sealing strip in the radial direction of the rotary piston and respectively outwards is limited. A widened central region is to be understood to be a widening formed in an area of the sealing strip that is central in the radial direction. The outward limitation of the movement space also leads, at high rotational speeds, to the sealing strips not being pushed outwards too greatly by centrifugal forces.

In other words, a rotary piston therefore has a cavity which is open radially outwards via a slot. Disposed in the slot is the sealing strip. The slot can be sealingly filled laterally by the sealing strip. The slot is narrower than the deformation body in the cavity so that the deformation body cannot exit through the slot. Disposed on the slot in a central region, i.e. neither directly adjacent to the cavity nor at the radially outer end of the slot, is a wider opening, which is referred to as a retaining groove. The sealing strip projects into this wider opening so that its movement space is limited in the radial direction.

Instead of, or in addition to, the retaining groove, other mechanisms can also be provided to limit an outward movement of the sealing strip. For example, the slot and the sealing strip can taper in outwardly (in the radial direction). The thicker inner region of the sealing strip prevents the sealing strip from slipping outwards through the slot.

The sealing strips can initially have a radial dimension that is somewhat greater than required for a seal. Excess material is then rubbed down during operation until a radial length is reached at which there is hardly any friction on the sealing strips and accordingly limited abrasion.

Each sealing strip has, in cross-section, a length or radial length, which is defined in the radial direction of the associated rotary piston, and a width perpendicular thereto. It can be provided that the radial length is at least three times greater than the width. The side ratios of the sealing strip are relevant for the deformation of the sealing strip under pressure. In particular if the sealing strip engages, with a tooth, surrounding it, of the rotary piston, in a depression of the respective other rotary piston, a pressure upon the sealing strip is important in order to deform it inwardly slightly. The friction between the sealing strip and the depression is thereby reduced. In particular an air film or an air lubrication can form, through which there is no contact, or hardly any contact, between a sealing strip and the other rotary piston, and material abrasion is therefore minimised. This desired effect can only occur, however, if the radial deformation of the sealing strip is sufficiently great under a pressure. For this, the radial length of the sealing strip should be at least three times the width of the sealing strip. This is in contrast for example with GB 2486787 A, where a wide and short sealing strip 54 cannot achieve the desired deformation.

In a further embodiment of the invention it can be provided in the generic rotary piston engine that each rotary piston has on its outer circumference a toothed wheel. The toothed wheels of the two rotary pistons mesh with each other and thus produce a sealing connection between them. In addition, a defined rotation position of the two pistons relative to each other and a common rotation speed of the two rotary pistons are hereby ensured. Each toothed wheel is interrupted by:

- at least two bulge portions which radially protrude over the respective toothed wheel and each comprise a slot to receive one of the sealing strips, and
- at least two depressions, in which the bulge portions of the respective other rotary piston engage when the two rotary pistons rotate together.

In this embodiment the bulge portions and the depressions are formed so that if one of the bulge portions engages in one of the depressions a sealing contact is produced between the toothed wheels directly in front of the depression and a first contact between this bulge portion and this depression arises on a rear face of the bulge portion with a rear portion of the depression, so that a gas inclusion and a gas compression arise in the depression. Through a further gas compression upon further rotation of the rotary pistons the pressure increases so much that the gas gradually escapes, a gas film thereby forming between the rotary pistons. The gas film has a friction-reducing effect and can also be described as air lubrication. The level of efficiency of the engine thereby increases and wear, in particular of the sealing strips, occurs only very slowly. This design is particularly effective if a gas is used as fluid, as the compression effect here is greater than in the case of liquids. With liquids too, however, this design can also be advantageously used.

Described above with the first contact is the point at which a bulge portion of a rotary piston and a depression of the other rotary piston first come into contact or move closest to each other when the rotary pistons rotate together. The rear portion of a depression and the rear face of the bulge portion are to be understood here to be rear in the sense of a direction of rotation of the associated rotary pistons. A bulge portion thus has three regions:

- a front face which is arched/curved and points forwards in the direction of rotation of the rotary piston;
- a central region which protrudes furthest and in which the slot for the sealing strip is formed, and
- a rear face which is arched/curved and points backwards in the direction of rotation of the rotary piston.

The shape of each bulge portion can form on both sides of the slot a respective plateau region. In the plateau region (the central region) a rotary piston radius, which is defined to the mid-point of the rotary piston, does not decrease. The radius accordingly decreases only once it is outside of the plateau region, thus on the front and rear face of the bulge portion. Thus, upon engagement of one of the bulge portions in one of the depressions, the first contact takes place between the depression and the rearmost of the plateau regions, or between the depression and the rear face of the bulge portion, i.e. the curved part of the bulge portion which follows behind the plateau region.

The dimensions of the two flat areas of the plateau region beside the sealing strip should together be as wide as, or wider than, the sealing strip in order that the desired contact can arise between the arched rear face and the depression wall of the other rotary piston. In particular the two flat areas should together have a width which is at least 80% of the width of the sealing strip. The plateau region does not have to be completely planar, a slight curvature or bend also being possible, in particular so that the plateau region has a constant external radius measured from the rotary piston mid-point. As an important advantage it is ensured through the shape of the bulge portions and the depressions that a gas film/air film forms at the outer ends of the bulge portions and the sealing strips which are held in the bulge portions, whereby friction is reduced. It can be particularly preferred to use this design together with the previously described resilience means of the sealing strips through cylindrical deformation bodies.

The rotary piston engine according to the invention can be used for in principle any applications, for example in biogas installations, thermal power stations, connected to generators for generating electricity, for driving vehicles or ships, for waste heat utilisation, in particular in power plants, vehicles or ships, or also in a configuration as an internal combustion engine. In this case it may be that the deformation body/silicone tube should be protected against excessively high temperatures of the combustion, for which purpose for example a pre-combustion chamber can be used for ignition, and gases arising during combustion may pass only after coming from the pre-combustion chamber (via for example a slit roller) into the interior space described here that has the rotary pistons. The rotary piston engine can also replace the turbine of a turbocharger, serve as a pump drive or be used in tools. In the described applications as an engine, the fluid pressure or the fluid flow is used in order to set the rotary pistons in rotation. In variants of the invention the engine can also be used the other way round by rotating the rotary pistons in order to transport a fluid, with which the engine acts as a pump, compressor or condenser. The properties of the invention described as additional features of the rotary piston engine also give rise, with proper usage, to variants of the method according to the invention.

BRIEF DESCRIPTION OF THE DRAWINGS

Further advantages and features of the invention are described below with reference to the accompanying schematic drawings, in which.

Identical and identically acting components are generally identified in the drawings by the same reference numerals.

DETAILED DESCRIPTION OF THE INVENTION

Figure 1:
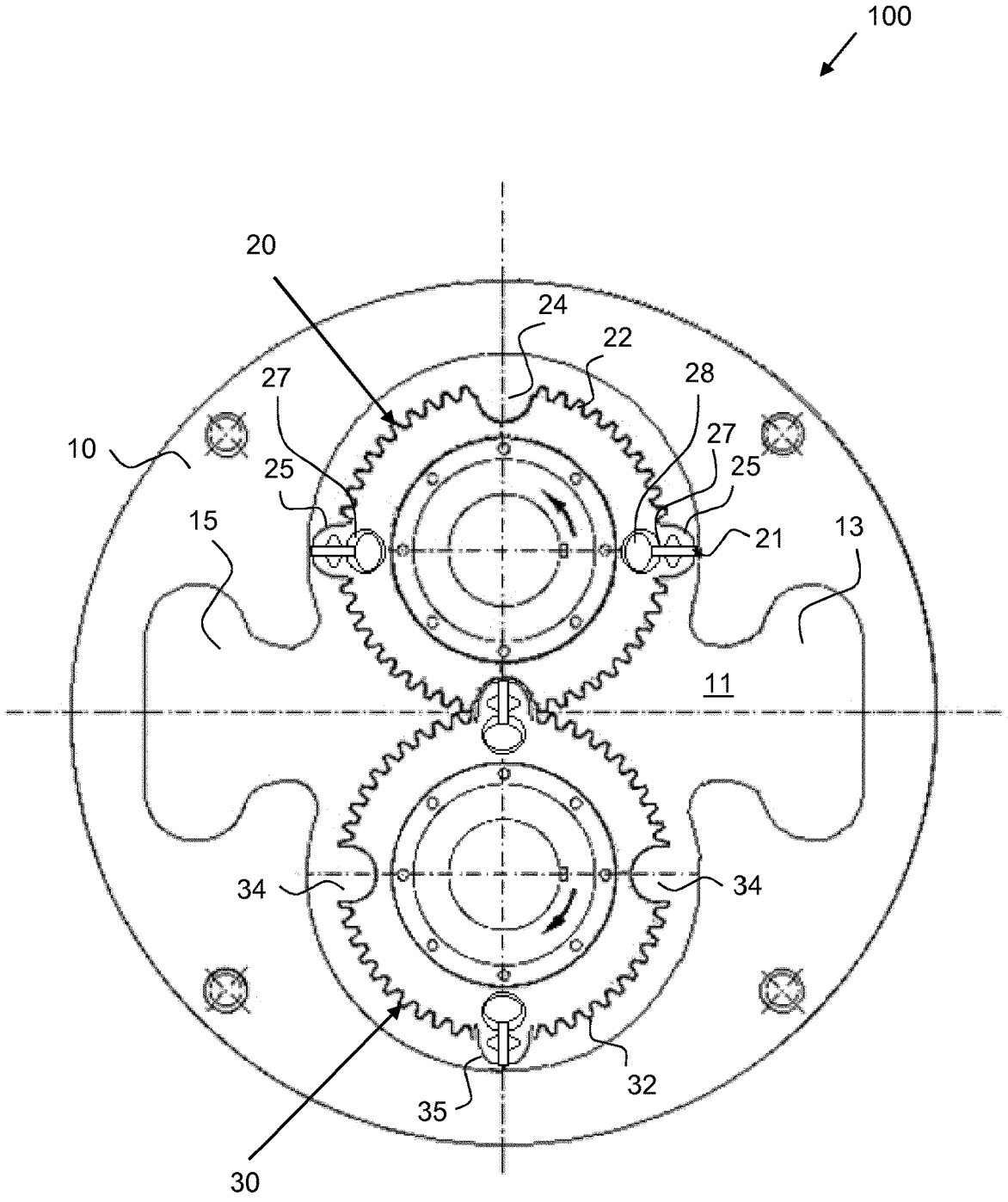
FIG. 1 shows a cross-section of a rotary piston engine according to an embodiment of the invention.
Figure 2:
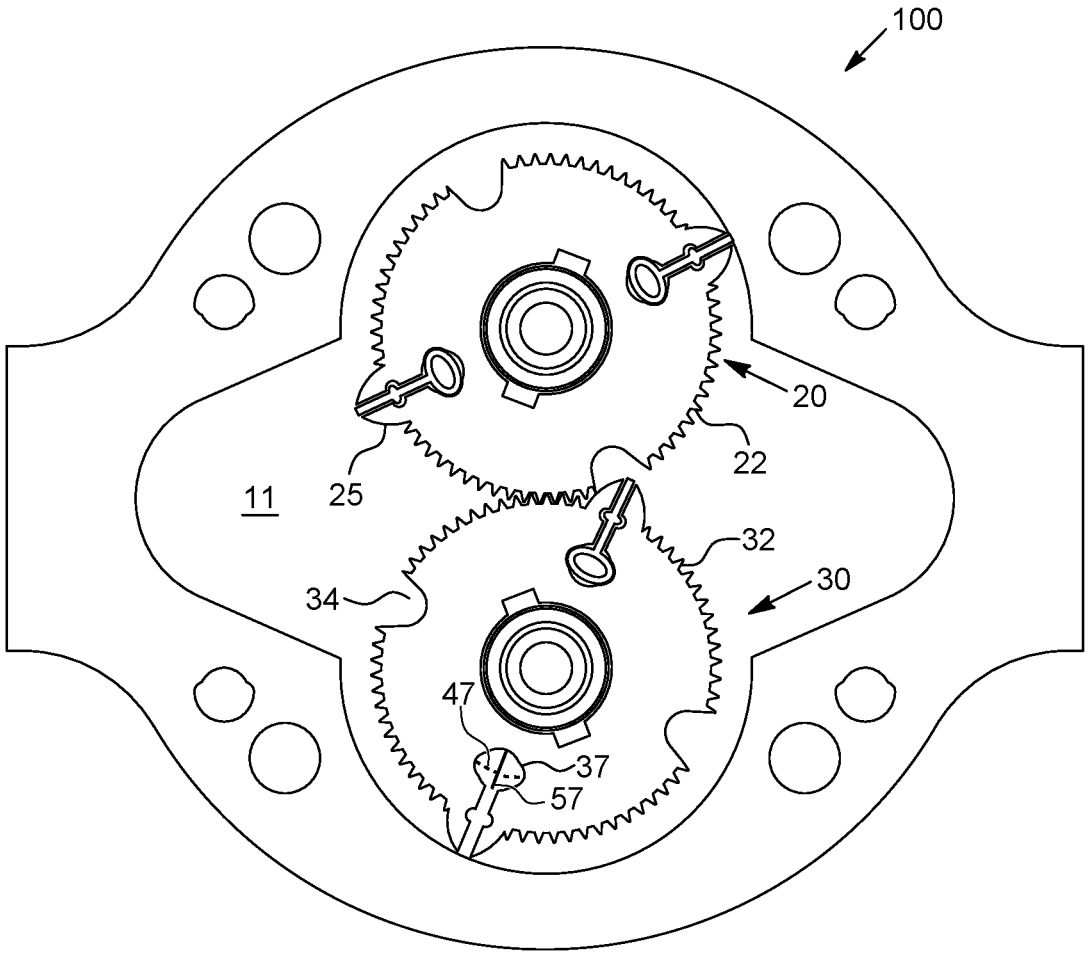
FIG. 2 shows a further cross-sectional representation of a rotary piston engine according to an embodiment of the invention.

Embodiments according to the invention of a rotary piston engine 100 will be described initially by reference to FIGS. 1 and 2. The rotary piston engine 100 comprises two rotary pistons 20, 30 which rotate together and can be driven by a fluid flowing through. The axes of rotation of the two rotary pistons 20, 30 extend through the respective midpoints of the rotary pistons 20, 30. The cross-sectional representations of FIGS. 1 and 2 are sectional views perpendicular to these axes of rotation.

The rotary piston engine 100 comprises a housing 10, for example a metal housing, which forms inside it an interior space 11. The interior space 11 can be formed fluid-tight apart from an inlet opening 13 and an outlet opening 15. In the interior space 11, the two rotary pistons 20, 30 are arranged so that they each form a sealing contact with the wall of the interior space 11 and also sealingly contact each other, independently of their momentary rotation position. If a fluid is guided through the inlet opening 13 into the interior space 11, it can consequently only reach the outlet opening 15 if it flows along the rotary pistons 20, 30 and sets these in rotation. The rotation energy of the rotary pistons 20, 30 can be used in a way that is known in principle for applications that are arbitrary in themselves, for example as a mechanical drive or to generate electrical energy by means of a generator.

The two rotary pistons 20, 30 have the same diameter and each of them has on its outer circumference a toothed wheel 22, 32. The two toothed wheels 22, 32 mesh with each other. A seal is hereby achieved between the two rotary pistons 20, 30 and a fluid passage is prevented in this position. In addition, the two rotary pistons 20, 30 rotate through the toothed wheels 22, 32 synchronously (one clockwise and the other anti-clockwise).

In addition each rotary piston 20, 30 has two bulge portions 25, 35 which protrude radially outwards over the respective toothed wheel 22, 32. Besides being interrupted by the bulge portions 25, 35, the two toothed wheels 22, 32 are also interrupted by two depressions 24, 34. In the regions of the depressions 24, 34, the respective rotary piston 20, 30 therefore has a smaller radius. When the rotary pistons 20, 30 rotate together, the bulge portion 35 of one of the rotary pistons 30 engages in the depression 24 of the other rotary piston 20, and vice versa.

Each bulge portion 25, 35 has a slot which can extend in the radial direction. Disposed in each slot is a sealing strip 21, 31 which projects outwardly out of the slot. The sealing strips 21, 31 can, in dependence on the rotation position of the rotary pistons 20, 30, sealingly contact the wall of the interior space.

The design of the sealing strip and its fixture and resilience means are of great importance for friction and sealing properties of the engine, through which the efficiency of the engine is largely determined. Frequently, sealing strips and their resilience means are also the components that are subject to the greatest wear, so that the design of the sealing strips and their resilience means is also of great importance for maintenance intervals and the service life of the engine.

Each sealing strip 21, 31 is received in a slot in one of the bulge portions 25, 35 on the rotary pistons. The slots each open into a cavity 27, 37. In conventional rotary piston engines there is disposed at the end of such slots a spring, for example a coil spring or leaf spring. However, these cause an uneven pressure: in the axial direction (from the drawing plane) a leaf spring has only in its centre a high pressure, which decreases sharply towards the edge. Coil springs also act selectively, i.e. area-wise. Furthermore, there is the risk—if such a metal spring breaks—of small metal particles penetrating into other parts of the engine and causing serious damage. These disadvantages are overcome by the provision in each cavity 27, 37 of one or a plurality of cylindrical deformation bodies 28, 38 which consist of an elastic material such as silicone or rubber. The deformation bodies 28, 38 each consist of a tube, in particular a silicone tube, or a solid elastic rod. The sealing strip 21, 31 projects as far as, or projects into, the cavity 27, 37 and against the silicone tube. The silicone tube is thereby compressed and exerts a radially outwardly orientated pressure on the sealing strip 21, 31. In the axial direction this cylindrical deformation body can have an equal cross-section so that a uniform pressure is exerted over the axial length. Furthermore, no metal parts are used so that, in the event of a break in the tube/deformation body, there is no risk of resulting damage to the engine.

FIG. 2 shows for illustration purposes on the rotary piston 30 only a single sealing strip with the associated tube, while the second cavity 37 and the slot adjacent thereto are shown empty. During use, of course, also disposed here are a tube as a resilience means in the cavity 37 and a sealing strip in the slot. The circumferential direction 47 (dashed line) and radial direction 57 (solid line) in which the cavity 37 extends are also illustrated in FIG. 2.

Each rotary piston can be symmetrically constructed, i.e. the shapes of the bulge portions, sealing strips and depressions to the fluid-inflow side being independent of the direction of rotation of the rotary piston. The rotary piston engine can thus be operated equally in both rotation directions 23 and 33 of rotary pistons 20 and 30, respectively. For a change of direction, the introduction of the fluid is merely reversed, thus being introduced through the outlet opening 15 into the interior space 11 and out through the inlet opening 13.

Figure 3:
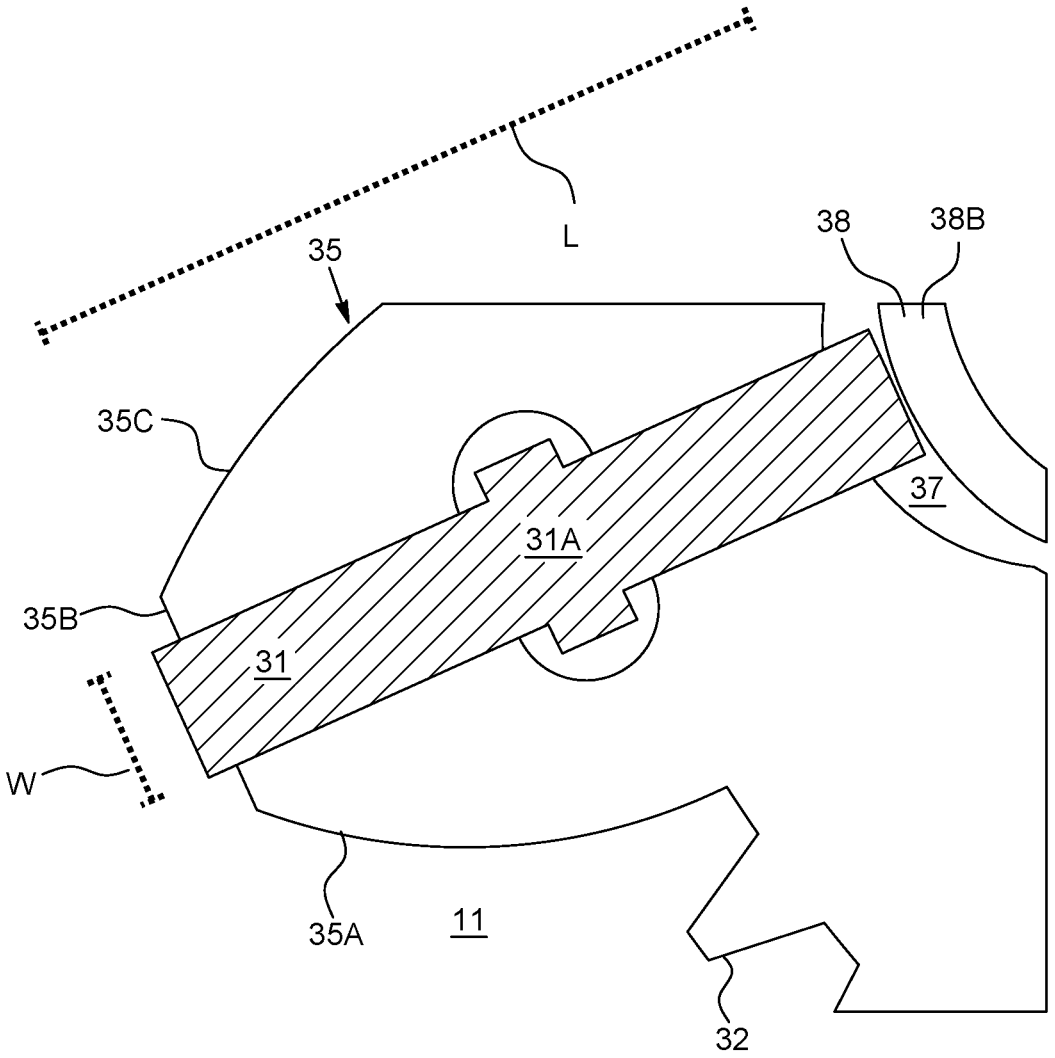
FIG. 3 shows an enlarged cut-out of the rotary piston engine of FIG. 2.

An enlarged cut-out of the rotary piston 30 is shown in FIG. 3. The sealing strip 31 projects radially outwards over the bulge portion 35 and projects inwards into the cavity 37, in which, here, a hollow tube 38B is used as a deformation body 38. A length (L) and width (W) of the sealing strip 31 are indicated in FIG. 3. The sealing strip 31 has in a central region a thickened area 31A. The gap or slot for the sealing strip has at a corresponding position a recess (retaining groove), into which the thickened area 31A projects. The sealing strip 31 thus has a cross-shaped cross-section. The sealing strip 31 is hereby held in the slot and cannot exit the slot either radially outwards or radially inwards. The cross-section dimensions of the sealing strip 31 and the position of the recess on the slot are selected so that the sealing strip 31 projects into the cavity 37 and (when the engine is stationary) compresses the tube 38B. The tube 38B is therefore pre-tensioned and causes, in the stationary state or upon start-up of the engine, a sealing contact of the sealing strip 31 with the inner wall of the housing. The tube 38B has a round cross-section, which can be circular shaped without pre-tension and, through the pre-tension against the sealing strip 31, can have an arched or oval shape. At higher speeds of the engine the centrifugal forces also push the sealing strip outwards and thus provide a sealing effect. In order to ensure that the pressure/pushing of the sealing strips outwards does not become unnecessarily large and produce unnecessary friction, through the thickened area 31A a movement space of the sealing strip 31 is outwardly limited. If at higher centrifugal forces the sealing strip 31 is pushed outwards through its own weight, the silicone tube 38B is hereby unburdened, which has a positive effect on the service life of the silicone tube 38B.

The thickened area 31A on the sealing strip 31 can in principle also be formed at its inner end, thus directly against the deformation body 38. A possible compression distance of the deformation body 38 is greater, however, if the contact area with the sealing strip is not too large, so that it can be advantageous if the thickened area 31A is formed in a central region. In addition, the thickened area 31A also limits the movement possibility of the sealing strip 31 inwards, thereby facilitating an exchange of the deformation body 38 for maintenance purposes.

The sealing action of the sealing strips 21, 31 is desired for the contact with the housing inner wall. On the other hand a seal between the two rotary pistons 20, 30 is already brought about through the intermeshing toothed wheels 22, 32 and also by the bulge portions 25, 35 engaging in the depressions 24, 34. Contact between the sealing strips 21, 31 and the depressions 34, 24 is not therefore required and on the contrary can even be undesirable, as the sealing strips 21, 31 are hereby ground down and would need to be replaced sooner.

Figure 4A:
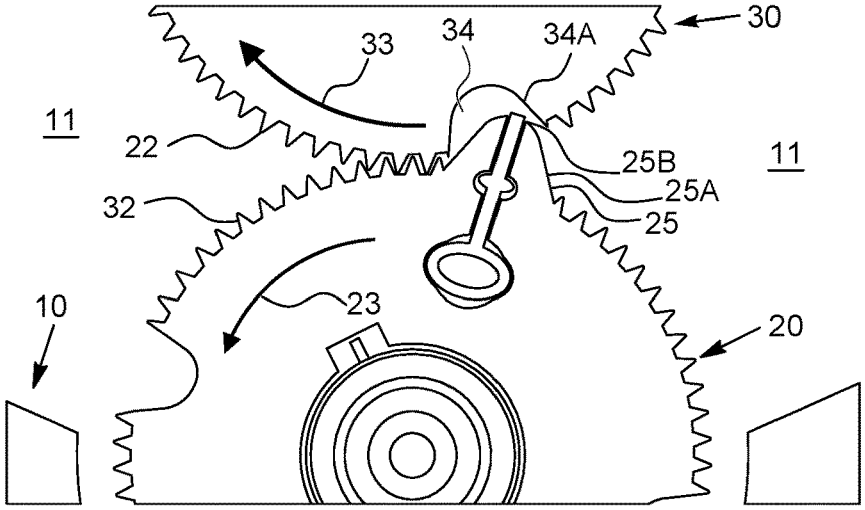
FIGS. 4A, 4B, 4C show cross-sectional views of the rotary piston engine of FIG. 2 in different rotation positions.
Figure 4B:
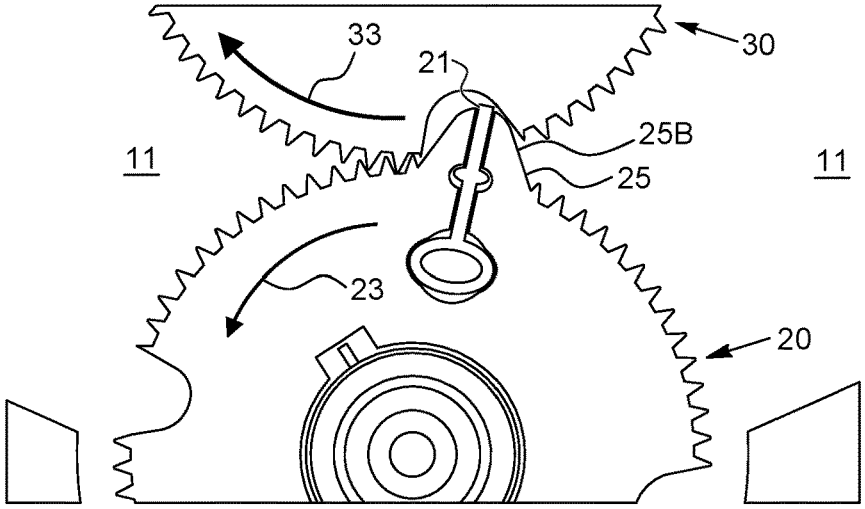

In order to overcome these disadvantages, a special form of the rotary pistons and the sealing strips is used, leading to particularly low friction between the rotary pistons. This will be described in more detail by reference to FIGS. 4A to 4C. These drawings show the contact area between the two rotary pistons 20, 30, wherein the drawings differ in the momentary rotation positions of the rotary pistons 20, 30. In FIG. 4A the bulge portion 25 (with rear face 25A) is still outside of the depression 34 (with rear portion 34A, whereas in FIG. 4B the bulge portion 25 is just dipping into the depression 34, and in FIG. 4C it has been almost completely received in the depression 34.

Figure 4C:
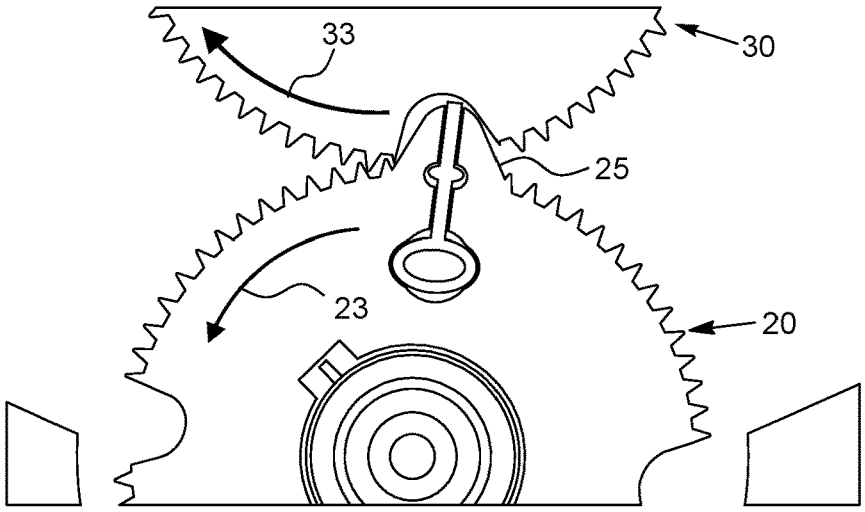

A sealing contact between the rotary pistons 20, 30 is already achieved in FIG. 4A through the intermeshing toothed wheels 22, 32 before the bulge portion 25 contacts a wall of the depression 34. The depression 34 is thus filled by the fluid in the interior space 11, wherein the toothed wheels 22, 32 prevent the fluid from leaving the depression 34 in the direction of rotation of the two rotary pistons. If the bulge portion 25 (having a rearmost portion 25B of a plateau portion) is driven into the depression 34 (FIG. 4B), the fluid in the depression 34 is compressed. The high pressure in the depression 34 pushes the sealing strip 21 into its slot. The sealing strip 21 does not hereby come into contact, or hardly comes into contact, with the wall of the depression 34, so that there is hardly any wear or friction on the sealing strip 21. If the rotary pistons 20, 30 are rotated further, the compressed air/the compressed fluid escapes from the depression 34 and indeed counter to the direction of rotation of the pistons 20, 30 (because in the direction of rotation of the pistons, through the toothed wheels, wherein constantly at least two teeth of each piston engage in two grooves of the other piston, no fluid can escape). Through this escape of the air, an air film or an air lubrication is produced on the sealing strip 21 and the bulge portion 25, thereby reducing the contact and thus avoiding unnecessary friction (FIG. 4C). This advantageous effect can be clearly demonstrated experimentally through the noise evolution of the air compression and can be distinguished from conventional structures, wherein, although bulge portions engage in depressions, an adequate seal is not produced that leads to the air compression and the friction-reducing air film.

For example, in GB 2486787A there is no tooth system that produces sufficient sealing in the direction of rotation, which would be necessary to make high air compression possible. In addition, the form of the bulge portion is important, as described in more detail below. As shown in FIG. 3, a bulge portion has a central straight region 35B which goes via curved lateral areas 35A and 35C to the toothed wheel 32. In order to protect the accommodated sealing strip 31 from abrasion against the wall of the depression 24, it is advantageous if an air compression arises in the depression 24 before the sealing strip comes into contact with the depression wall. For this, when the bulge portion 35 dips into the depression 24, a first contact (or alternatively a very small distance) can arise between the bulge portion 35 and the depression 24 at a position of the bulge portion 35 behind (i.e. behind as viewed in the direction of rotation) the sealing strip 31. This is either the arched region 35C (curved portion 35C) in FIG. 3 or the central plateau region 35B between the sealing strip 31 and the arched region 35C. In order to achieve this, the bulge portion 35 must be sufficiently wide. This can be the case in particular if the plateau region between the sealing strip 31 and the arched region 35C corresponds to at least 40% of the sealing strip width.

Preferably, this friction-reducing utilisation of an air film is used together with the sealing strip resilience means through a silicone tube or a similar cylindrical deformation body.

The various aspects of the invention thus offer a rotary piston engine having an excellent level of efficiency at the same time as low wear.

The invention claimed is:

1. A rotary piston engine, comprising:

a housing which forms an interior space, and at least two rotary pistons which are arranged in the interior space, wherein on the interior space an inlet opening and an outlet opening are formed to guide a fluid through the interior space along the pistons, wherein each rotary piston has on its outer circumference at least two sealing strips, wherein:

each rotary piston has at least two cavities, in each of which an elastic elongated deformation body is arranged, which comprises a tube or an elastic solid rod, wherein the sealing strips project into the cavities and against the elastic elongated deformation body received therein, and are pushed radially outwards by said elastic elongated deformation body.

2. The rotary piston engine according to claim 1, wherein:

each tube or each elastic solid rod is formed by a plurality of tube or rod components, which are arranged one over the other in the respective cavity.

3. The rotary piston engine according to claim 2, wherein:

each cavity has a cylindrical shape with a longitudinal axis which extends parallel to a longitudinal axis of the rotary pistons, and each tube extends over an entire length of the associated cavity, wherein the respective tube is in contact over the whole length with the associated sealing strip and pushes it outwards.

4. The rotary piston engine according to claim 1, wherein: each elastic elongated deformation body is cylindrical and has a longitudinal axis parallel to an axis of rotation of the associated rotary piston.

5. The rotary piston engine according to claim 1, wherein: the tube or the elastic solid rod consists of a non-metallic material.

6. The rotary piston engine according to claim 1, wherein: the tube or the elastic solid rod has a round or circular shaped cross-section.

7. The rotary piston engine according to claim 1, wherein: each tube has an external radius which is about equal to a radius of the associated cavity, in which the respective tube is received.

8. The rotary piston engine according to claim 1, wherein: each cavity has a dimension in a circumferential direction of the associated rotary piston which is greater than a dimension of the cavity in a radial direction of the associated rotary piston.

9. The rotary piston engine according to claim 1, wherein: each sealing strip has in cross-section a widened central region, which engages in a corresponding retaining groove in the respective rotary piston, whereby a movement space of the sealing strip is limited in a radial direction of the associated rotary piston.

10. The rotary piston engine according to claim 1, wherein:

each rotary piston has on its outer circumference a toothed wheel which is interrupted by:

at least two bulge portions which protrude over the toothed wheel, each comprising a slot to receive one of the sealing strips, and at least two depressions, in which the bulge portions of the respective other rotary piston engage during a rotation of the rotary pistons, wherein the bulge portions and the depressions are formed so that, upon engagement of one of the bulge portions in one of the depressions, a sealing contact is produced between the toothed wheels directly in front of the depression, and a first contact between this bulge portion and this depression is realised between a rear face of the bulge portion and a rear portion of the depression, so that a gas inclusion and a gas compression take place in the depression, whereby, through a further gas compression upon further rotation of the rotary pistons, a friction-reducing gas film forms between the rotary pistons.

11. The rotary piston engine according to claim 10, wherein:

the shape of each bulge portion forms on both sides of the slot a respective plateau region, over which a rotary piston radius, which is defined to the mid-point of the rotary piston, does not decrease, so that, upon engagement of one of the bulge portions in one of the depressions, the first contact is realised between the depression and a rearmost of the plateau regions defined based on a direction of rotation of the associated rotary piston, or between the depression and a curved portion of the bulge portion which follows behind the plateau region.

12. The rotary piston engine according to claim 10, wherein:

each sealing strip has in cross-section a length and a width, wherein the length is defined in a radial direction of the associated rotary piston, and wherein the length is at least three times greater than the width.

13. A method for operating a rotary piston engine, the method comprising:

introducing a fluid through an inlet opening on a housing, which forms an interior space, wherein at least two rotary pistons are arranged in the interior space, wherein, as the fluid flows through the interior space to an outlet opening, it drives the rotary pistons, wherein each rotary piston has on its outer circumference at least two sealing strips, wherein: each rotary piston has at least two cavities, in each of which an elastic elongated deformation body is arranged, which comprises a tube or an elastic solid rod, wherein the sealing strips project into the cavities and against the elastic elongated deformation body received therein and are pushed radially outwards by said deformation body.

* * * * *